US010005654B2

(12) United States Patent
Kraenzle

(10) Patent No.: US 10,005,654 B2
(45) Date of Patent: Jun. 26, 2018

(54) APPARATUS, SYSTEMS, AND METHODS RELATING TO TRANSFER OF FLUIDS TO/FROM CONTAINERS AND/OR STORAGE/TRANSPORT OF FLUIDS IN CONTAINERS

(71) Applicant: David G. Kraenzle, St. Louis, MO (US)

(72) Inventor: David G. Kraenzle, St. Louis, MO (US)

( * ) Notice: Subject to any disclaimer, the term of this patent is extended or adjusted under 35 U.S.C. 154(b) by 0 days. days.

(21) Appl. No.: 14/825,860

(22) Filed: Aug. 13, 2015

(65) Prior Publication Data

US 2017/0043994 A1 Feb. 16, 2017

(51) Int. Cl.

| | |
|---|---|
| ***B65B 1/04*** | (2006.01) |
| ***B67D 1/04*** | (2006.01) |
| ***B67D 1/00*** | (2006.01) |
| ***B67D 1/08*** | (2006.01) |
| ***B67D 1/12*** | (2006.01) |

(52) U.S. Cl.

CPC ..... *B67D 1/0462* (2013.01); *B67D 1/0001* (2013.01); *B67D 1/0807* (2013.01); *B67D 1/1277* (2013.01); *B67D 2001/0822* (2013.01)

(58) Field of Classification Search

CPC .. B67D 1/0462; B67D 1/0001; B67D 1/1277; B67D 1/0807; B67D 7/0238–7/0261; B65D 77/06; B65D 77/067; B65D 77/068

See application file for complete search history.

(56) References Cited

U.S. PATENT DOCUMENTS

| | | | | |
|---|---|---|---|---|
| 811,811 | A | 2/1906 | Allison | |
| 2,263,293 | A * | 11/1941 | Ewald | F16L 37/0841 251/149.6 |
| 2,564,163 | A * | 8/1951 | Leperre | B65D 77/06 141/114 |
| 3,922,099 | A * | 11/1975 | Christine | A23G 3/28 222/107 |
| 4,132,334 | A * | 1/1979 | Danks | B65D 55/00 141/348 |
| 4,143,853 | A * | 3/1979 | Abramson | A61M 39/26 137/515.7 |

(Continued)

OTHER PUBLICATIONS

Cross-slit Valves—Minivalve; http://minivalve.com/newsite/index.php/en/by-type/cross-slit-valves/components; accessed Jul. 28, 2015, 1 page.

(Continued)

*Primary Examiner* — Patrick M Buechner
*Assistant Examiner* — Randall Gruby
(74) *Attorney, Agent, or Firm* — Harness, Dickey & Pierce, P.L.C.

(57) ABSTRACT

Disclosed are exemplary embodiments of apparatus, systems and methods relating to transfer of fluids to/from containers and/or storage/transport of fluids in containers. In an exemplary embodiment, an apparatus comprises a container including a fitment having an opening. The apparatus may include a valve within the fitment. The valve may be configured to inhibit fluid flow out of the container. The apparatus may also include a transfer tube configured to be positioned through the opening of the fitment. The transfer tube may engage and open the valve to thereby provide an open passage to/from the container.

35 Claims, 17 Drawing Sheets

(56) References Cited

U.S. PATENT DOCUMENTS 4,162,030 A * 7/1979 Capra ..... B05B 9/0822 222/105
4,230,112 A 10/1980 Smith
4,264,019 A * 4/1981 Roberts ..... B67D 1/0412 222/105
4,303,071 A 12/1981 Smith
4,317,448 A 3/1982 Smith
4,376,634 A * 3/1983 Prior ..... G01N 33/579 422/562
4,436,125 A * 3/1984 Blenkush ..... F16L 37/0841 137/797
4,436,519 A * 3/1984 O'Neill ..... A61M 39/04 137/847
4,570,833 A * 2/1986 Vanderjagt ..... B67D 7/62 222/333
RE32,354 E 2/1987 Savage
4,702,397 A * 10/1987 Gortz ..... A61M 5/152 222/211
4,784,657 A 11/1988 Shimp et al.
4,834,152 A 5/1989 Howson et al.
4,842,591 A * 6/1989 Luther ..... A61M 39/26 285/3
4,854,486 A * 8/1989 Daley ..... B67D 3/02 137/588
4,944,736 A 7/1990 Holtz
4,954,149 A 9/1990 Fullemann
4,996,760 A * 3/1991 Coleman ..... B65D 77/061 220/495.05
5,006,118 A 4/1991 Yule
5,036,992 A 8/1991 Mouchawar et al.
5,060,826 A * 10/1991 Coleman ..... B41F 31/02 222/105
5,202,093 A 4/1993 Cloyd
5,242,412 A 9/1993 Blake, III
5,251,787 A * 10/1993 Simson ..... B67D 1/0462 222/105
5,265,766 A * 11/1993 Kurtzahn ..... A47J 41/0061 141/18
5,280,876 A * 1/1994 Atkins ..... F16L 37/113 251/144
5,337,922 A 8/1994 Salkeld et al.
5,360,413 A * 11/1994 Leason ..... A61M 39/26 137/843
5,390,898 A * 2/1995 Smedley ..... A61M 39/26 251/149.1
5,465,938 A * 11/1995 Werge ..... A61M 39/04 137/843
RE35,167 E 3/1996 Mouchawar et al.
5,520,665 A * 5/1996 Fleetwood ..... A61M 39/26 604/246
5,531,810 A 7/1996 Fullemann
5,573,525 A 11/1996 Watson et al.
5,586,690 A * 12/1996 Ettore ..... B65D 77/067 222/105
5,598,939 A 2/1997 Watson et al.
5,613,622 A * 3/1997 Surrena ..... B65D 90/046 220/23.87
5,620,434 A * 4/1997 Brony ..... A61J 1/2096 141/320
5,673,818 A * 10/1997 Kaneski ..... B67D 7/0277 222/105
5,702,019 A * 12/1997 Grimard ..... A61J 1/2096 141/24
5,732,853 A * 3/1998 Ganzeboom ..... A47K 5/12 222/181.3
5,749,861 A * 5/1998 Guala ..... A61M 39/26 251/149.1
5,782,382 A * 7/1998 Van Marcke ..... A47K 5/1214 222/105
5,957,898 A 9/1999 Jepson et al.
6,155,465 A * 12/2000 Steiger ..... B67D 3/043 222/501
6,261,282 B1 7/2001 Jepson et al.
6,328,543 B1 * 12/2001 Benecke ..... A47L 13/20 222/383.1
6,482,181 B1 11/2002 Racenet et al.
6,669,681 B2 12/2003 Jepson et al.
6,691,893 B2 * 2/2004 Gauthier ..... A47K 5/1211 222/389
6,702,787 B2 3/2004 Racenet et al.
6,860,869 B2 3/2005 Dennis
7,112,185 B2 9/2006 Hart et al.
7,163,525 B2 1/2007 Franer
7,244,244 B2 7/2007 Racenet et al.
7,308,991 B2 * 12/2007 Alberg ..... B65D 23/02 156/291
7,316,329 B2 * 1/2008 Wertenberger ..... B65D 77/06 222/105
7,607,555 B2 * 10/2009 Smith ..... B65D 77/067 215/257
7,635,357 B2 12/2009 Mayer
7,713,250 B2 5/2010 Harding et al.
7,789,861 B2 9/2010 Franer
7,806,299 B2 * 10/2010 Wauters ..... B67D 1/0831 222/129.1
7,810,579 B2 10/2010 Wauters et al.
7,833,199 B2 11/2010 Franer et al.
7,918,826 B2 4/2011 Armstrong et al.
7,947,032 B2 5/2011 Harding et al.
7,981,090 B2 * 7/2011 Plishka ..... A61M 39/045 604/246
8,122,922 B2 2/2012 Baker
8,360,277 B2 * 1/2013 Rasmussen ..... B67D 1/0462 222/105
8,360,278 B2 * 1/2013 Fiedler ..... B67D 7/0255 222/105
8,413,857 B2 4/2013 Johnson
8,485,231 B2 7/2013 Young
8,561,856 B2 * 10/2013 Kuperus ..... B67D 1/0831 141/346
8,596,496 B2 * 12/2013 Malinski ..... B67D 3/0009 222/105
8,899,445 B2 * 12/2014 Rasmussen ..... B67D 1/0462 222/105
9,016,528 B2 * 4/2015 Peirsman ..... B67D 1/0412 222/396
9,493,278 B2 * 11/2016 Meinzinger ..... B65D 41/20
9,592,944 B2 * 3/2017 Johnson
2001/0002675 A1 * 6/2001 Wilcox ..... B65D 77/06 222/95
2003/0062383 A1 * 4/2003 Meike ..... B67D 1/04 222/95
2003/0102335 A1 * 6/2003 Barnett ..... B05B 9/0816 222/386.5
2004/0094572 A1 * 5/2004 Rubinstein ..... B65D 33/02 222/95
2006/0043113 A1 * 3/2006 Verespej ..... B65D 47/0814 222/153.01
2006/0138177 A1 * 6/2006 Wauters ..... B67D 1/0431 222/386.5
2006/0249536 A1 * 11/2006 Hartman ..... B67D 1/0004 222/129.3
2006/0283879 A1 * 12/2006 Rasmussen ..... B67D 1/0001 222/81
2007/0235471 A1 * 10/2007 Radermacher .... B05C 17/00583 222/95
2009/0212071 A1 * 8/2009 Tom ..... B65B 31/003 222/95
2010/0024914 A1 * 2/2010 Baker ..... B65D 51/002 141/27
2010/0133273 A1 * 6/2010 Thurman ..... B65D 47/0838 220/260
2012/0187153 A1 * 7/2012 Burge ..... B67D 1/0462 222/386.5
2012/0187158 A1 * 7/2012 Pritchard ..... B65D 47/103 222/501
2014/0117043 A1 * 5/2014 Ware ..... B65D 85/84 222/95

(56) References Cited

U.S. PATENT DOCUMENTS

| | | | | |
|---|---|---|---|---|
| 2014/0131380 | A1* | 5/2014 | Pethe | B67D 7/0255 222/95 |
| 2014/0319094 | A1* | 10/2014 | Thurman | B65D 75/5877 215/253 |
| 2014/0339258 | A1* | 11/2014 | Koland | B65D 77/06 222/105 |
| 2014/0374443 | A1 | 12/2014 | Young et al. | |
| 2016/0251209 | A1* | 9/2016 | Standaert | B67D 1/0462 222/95 |

OTHER PUBLICATIONS

Duckbill Valves—Minivalve; http://minivalve.com/newsite/index.php/en/by-type/duckbill-valves/components; accessed Jul. 28, 2015; 1 page.

* cited by examiner

APPARATUS, SYSTEMS, AND METHODS RELATING TO TRANSFER OF FLUIDS TO/FROM CONTAINERS AND/OR STORAGE/TRANSPORT OF FLUIDS IN CONTAINERS

FIELD

The present disclosure relates to transferring fluids to/from containers and/or storing/transporting fluids in containers.

BACKGROUND

This section provides background information related to the present disclosure which is not necessarily prior art.

Carbonated beverages are popular drinks of choice for many people. Examples of popular carbonated beverages include beer, carbonated water, soda, etc.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
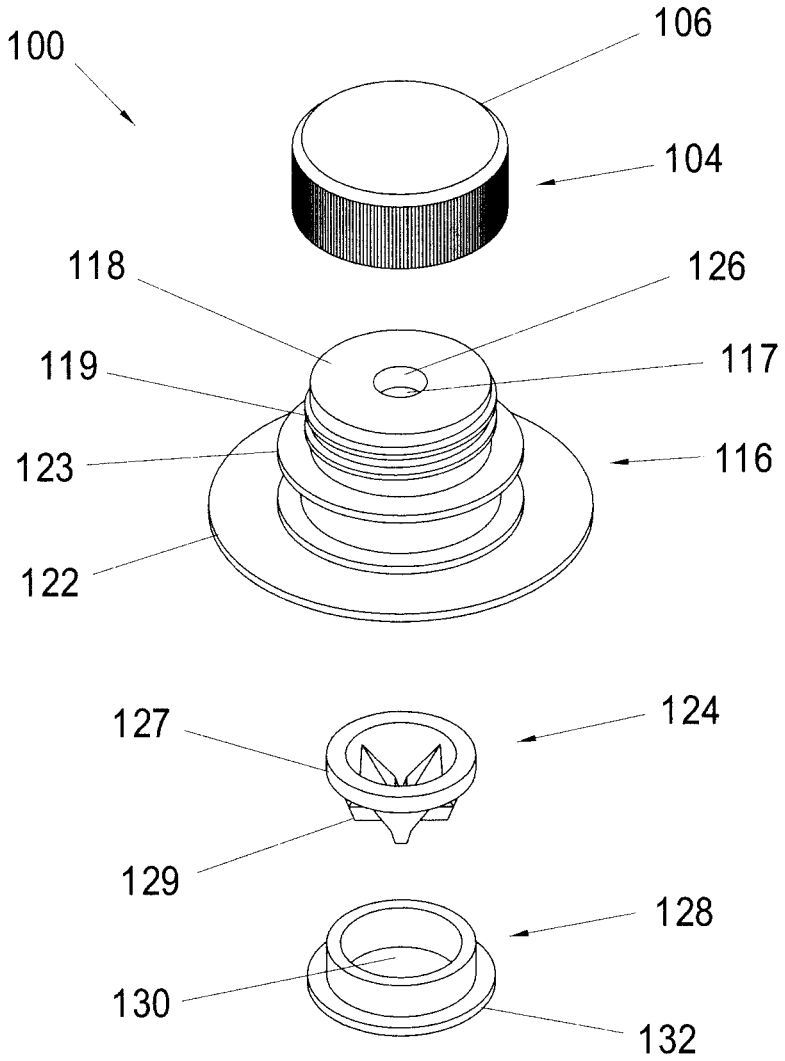
FIGS. 1 and 2 are exploded views of an apparatus that may be used for transfer of a liquid to/from a container and for storage/transport of the liquid in the container according to an exemplary embodiment.

Example embodiments will now be described more fully with reference to the accompanying drawings.

For the past few decades, efforts have been made to produce inexpensive, disposable packaging for various liquids, in particular, beverages, and even more particularly, beer. In general, the focus of these efforts has been to create various forms of packaging designed to be filled by automated means, usually in mass quantities in a factory, and emptied (dispensed) by the consumer either manually or by some type of dispensing apparatus. In many cases, large beverage manufacturers initiated these efforts in order to create a proprietary package that would help to facilitate the sales of their beverage(s). As a result, the particular packaging/dispensing system developed is exclusive to a particular beverage brand (or brands), thus limiting the consumer to only those brands offered for use with that particular packaging/dispensing system.

Also, a major challenge for small beverage manufacturers is the distribution of their product(s). For example, bottling or canning beer is cost prohibitive to a lot of small brewers thereby limiting them to kegs. While there is clearly a market for keg beer, in many (if not most) instances, a keg of beer is too large of a quantity and is too inconvenient to handle and use.

Recent laws have been passed in a number of states (growler laws) allowing the filling of consumer-supplied containers by retail merchants. The problem with filling an open container with draft beer, even if resealed, is that upon exposure to air (oxygen) the shelf life of the beer is dramatically reduced, typically limited to two or three days.

Yet another issue applies to home brewers. The general consensus among people who brew their own beer is that the bottling step is the most undesirable step in the process due, in general, to the cost, inconvenience, and labor involved.

The inventor hereof recognized the above and then identified that a need therefore exists for a packaging/dispensing system that 1) allows the consumer to choose any beverage brand available, 2) maintains the original quality of the beverage, 3) is inexpensive, and 4) is easy to use.

Unlike some other beverages, a carbonated beverage, particularly beer, tends to be fragile and may be easily damaged if agitated or overexposed to air or light. For example, beer may be agitated and damaged when dispensed through an "open" pinch valve if the pinch valve is not fully open due to memory of the pinch valve material preventing the pinch valve from remaining fully open. As another example, beer may be damaged when too much carbon dioxide (over carbonation) is added into the same container that includes the beer, which is a traditional process for dispensing beer.

After recognizing the above, the inventor hereof developed and discloses herein exemplary embodiments of apparatus, systems, and methods for transferring beer to/from a container without the beer being damaged due to agitation, without overexposure to air, and/or without requiring a separate carbonation source as is traditionally required for dispensing beer. As disclosed herein, exemplary embodiments may allow a user to individually fill a container with beer, store the beer within the container, and then dispense the beer from the container. All of which may be accomplished without damaging agitation and without requiring a separate carbonation source to dispense the beer. In addition, the beer is also not overexposed to air (e.g., with little or no exposure to outside air, etc.), which may also damage beer. In exemplary embodiments, the beer is not exposed to the outside environment (e.g., to air, etc.) until the beer is dispensed from a transfer tube (broadly, conduit) into a user's cup, glass, etc. Also in exemplary embodiments, beer may be stored in a substantially airtight manner such that the beer won't lose its carbonation and become flat during storage. Accordingly, exemplary embodiments may thus provide one or more or all of the following important packaging requirements: liquid barrier, light barrier, oxygen barrier, maintain sufficient pressure, and maintain chilled (if not pasteurized like draft beer).

Figure 2:
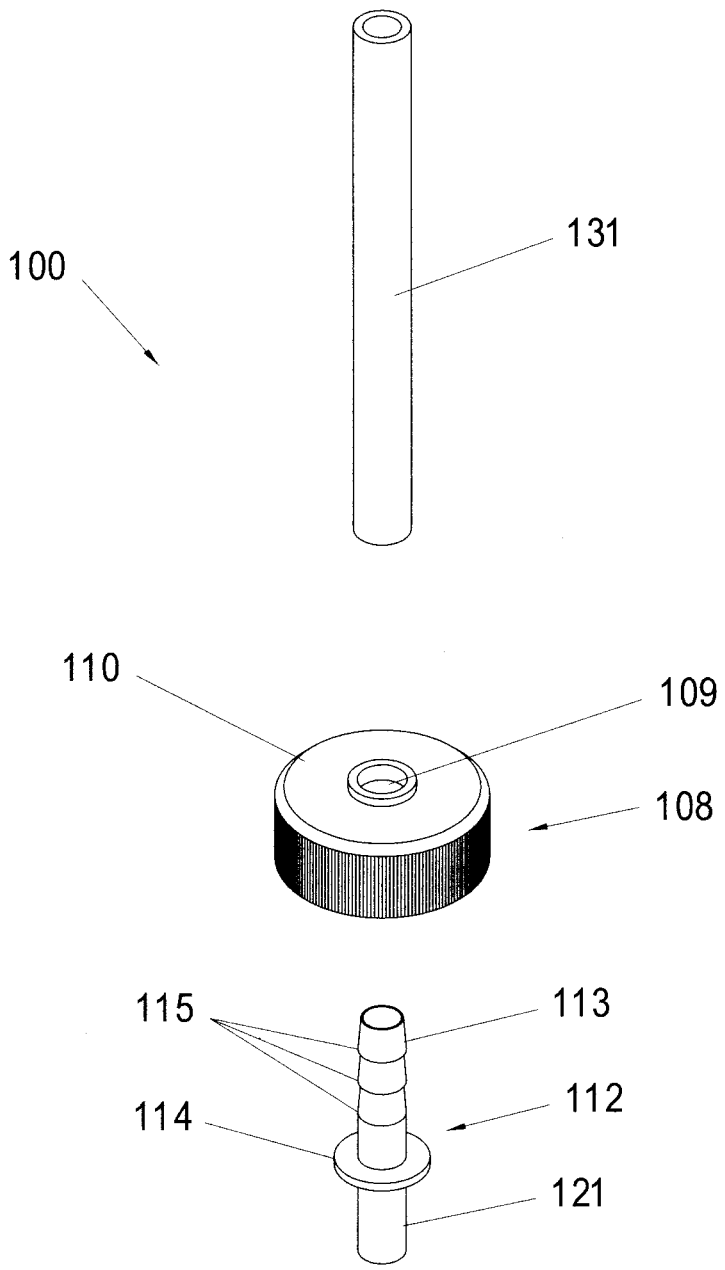
Figure 3:
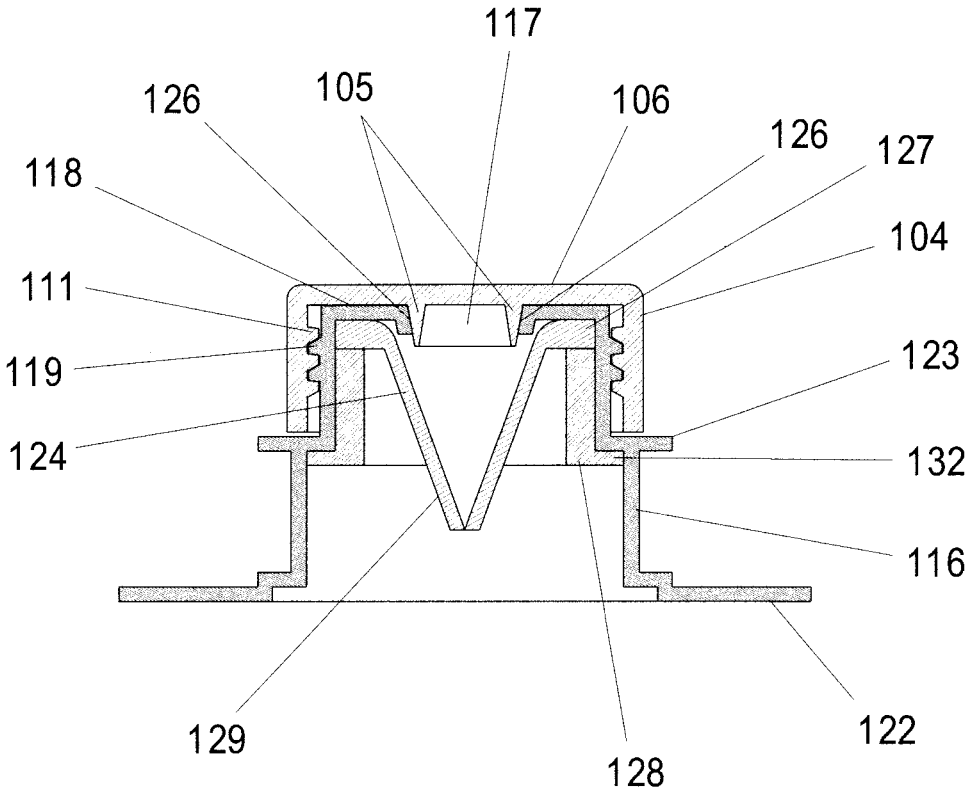
FIGS. 3 and 4 are cross-sectional assembly views of the apparatus shown in FIGS. 1 and 2, where the apparatus shown in FIG. 3 includes a different valve than the valve shown in FIG. 1.
Figure 4:
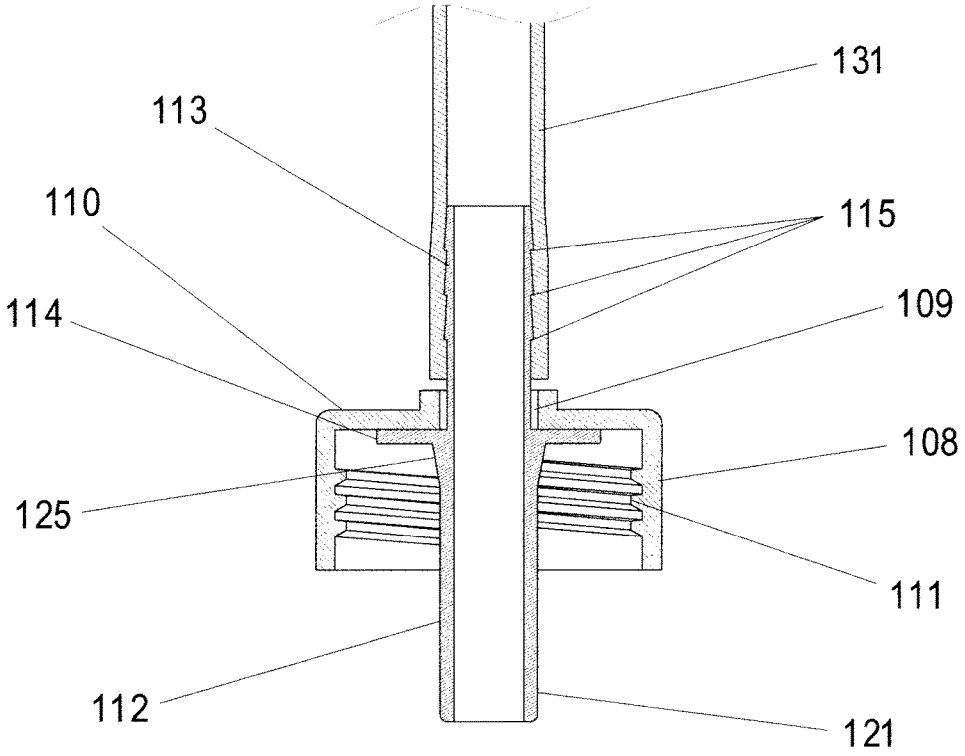
Figure 5:
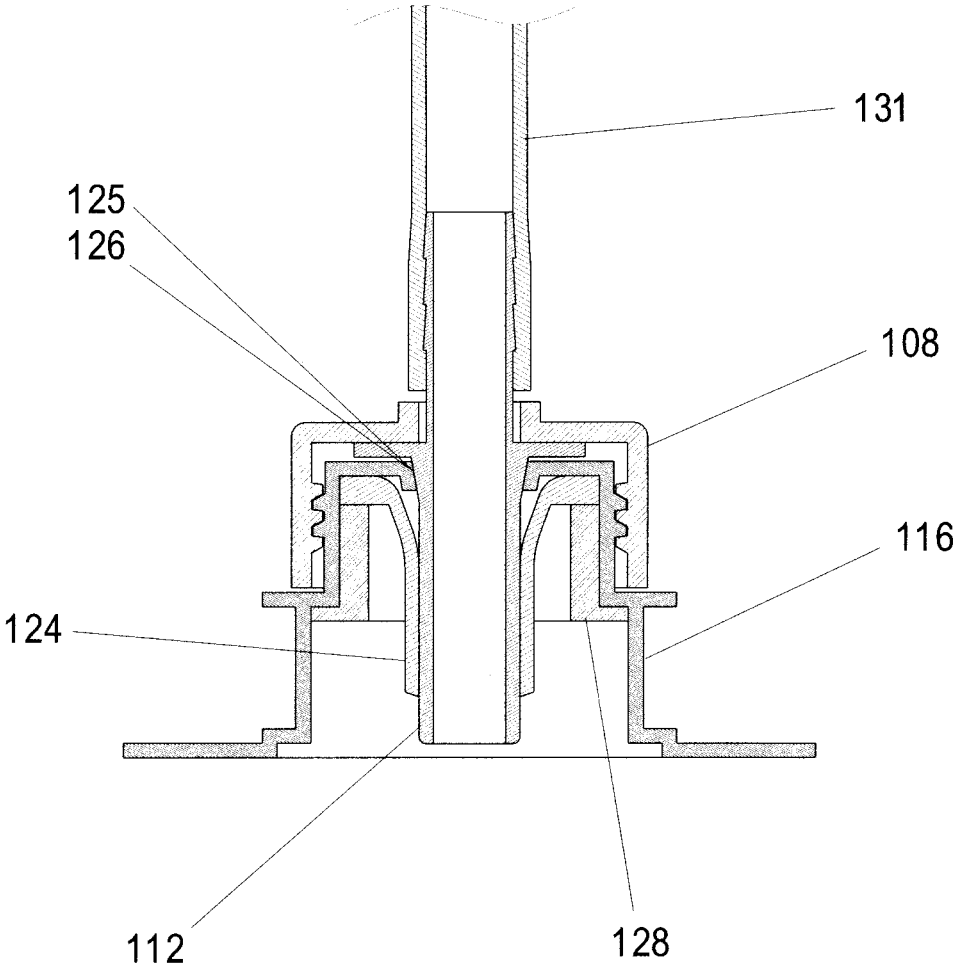
FIG. 5 is a cross-sectional view of the apparatus shown in FIGS. 3 and 4 assembled together in a transfer condition (e.g., for dispensing from or filling a container, etc.)
Figure 10:
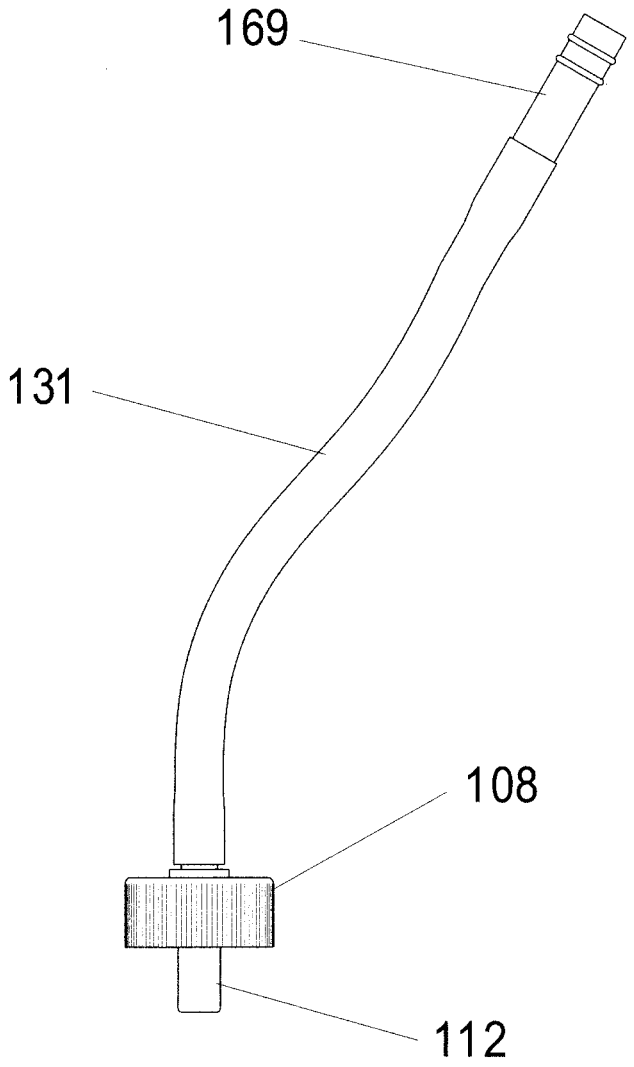
FIG. 10 illustrates the apparatus shown in FIGS. 2 and 4 with a conduit (e.g., flexible tube or hose, etc.) attached to the transfer tube and an adapter at an end of the conduit for connection to a faucet.
Figure 11:
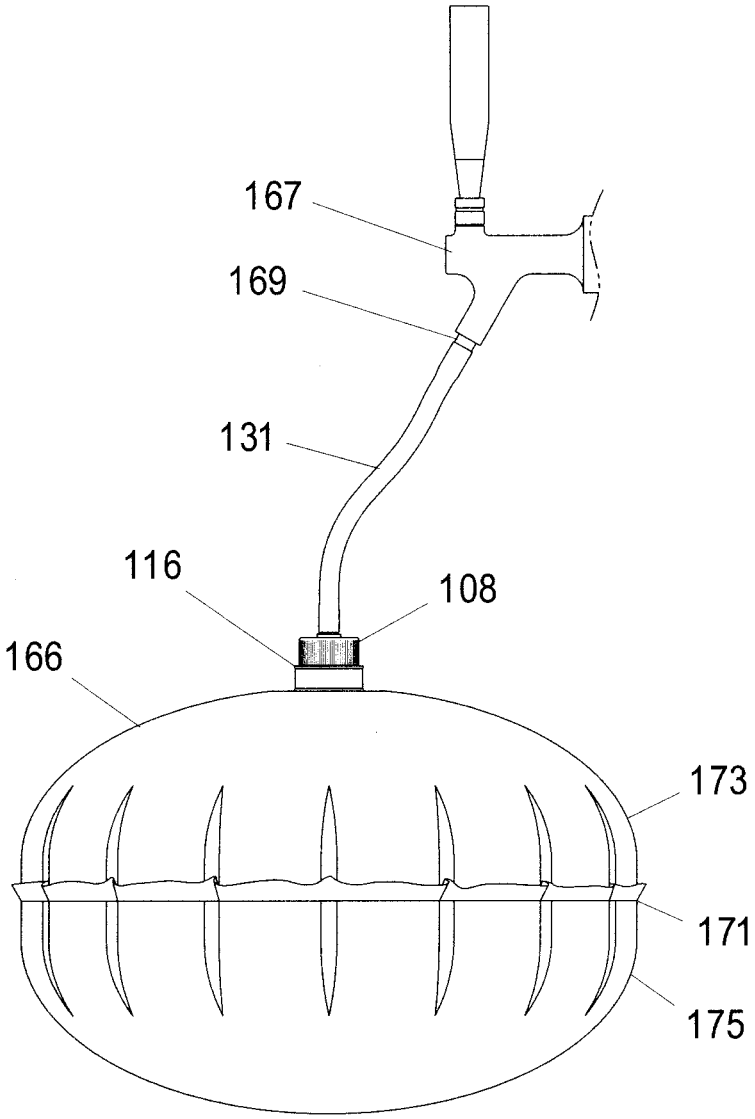
FIG. 11 illustrates the apparatus shown in FIG. 10 connected to the flexible container shown in FIG. 9 and a front of a faucet via the adapter for filling the flexible container.
Figure 12:
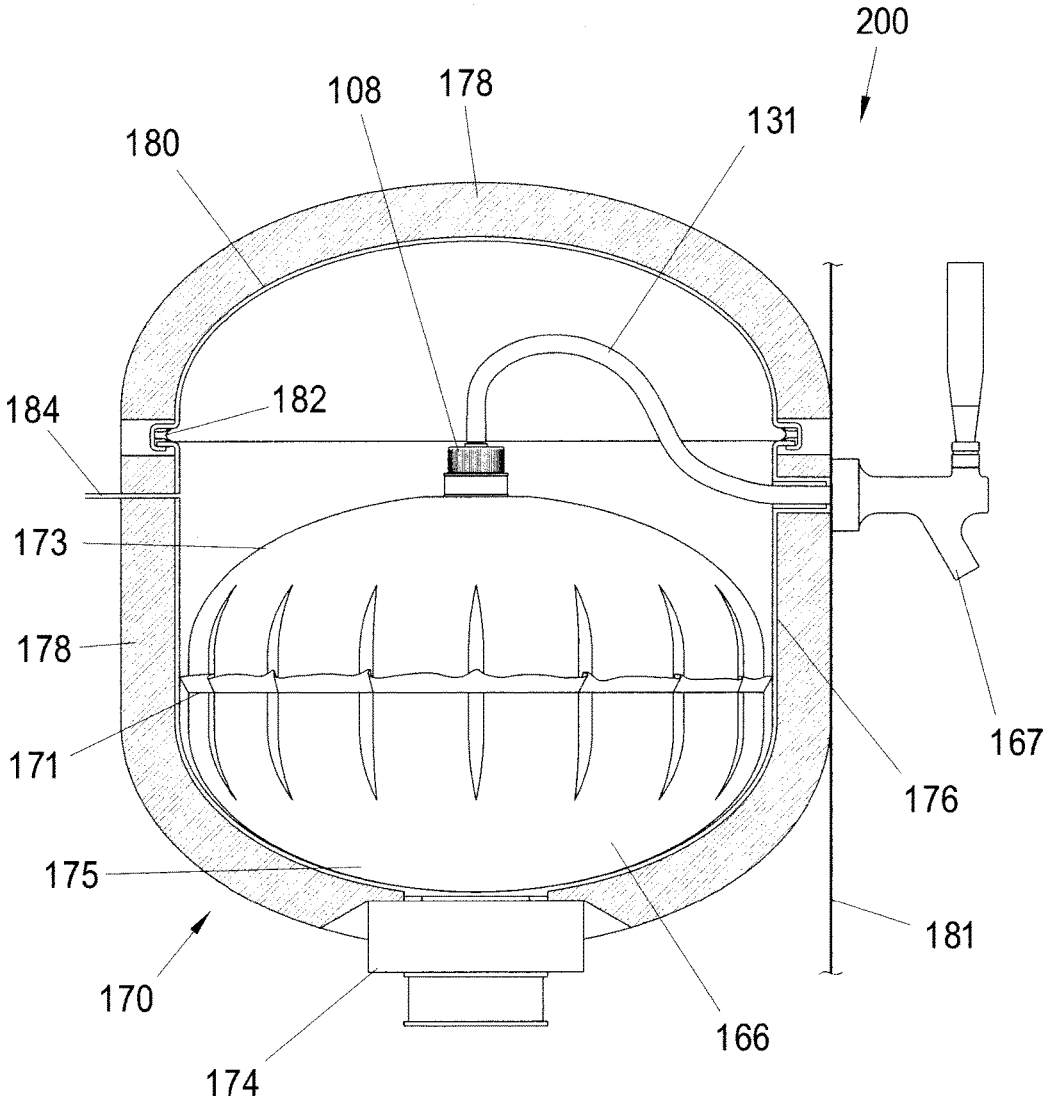
FIG. 12 illustrates the apparatus and flexible container shown in FIG. 11 positioned within a pressure vessel, where the apparatus is now connected to a rear of a faucet for dispensing from or emptying the flexible container.

With reference now to the figures, FIGS. 1 and 2 illustrates an exemplary embodiment of an apparatus 100 embodying one or more aspects of the present disclosure. As shown in FIG. 1, the apparatus 100 includes a storage/transport cap or closure 104, a fitment or spout 116, a valve 124, and a retainer 128. As shown in FIG. 2, the apparatus 100 also includes a transfer cap or closure 108 and a transfer tube or conduit 112. The transfer tube 112 is configured to be attached to a conduit 131 as shown in FIGS. 4, 5, and 10. As disclosed herein, the apparatus 100 may be used for transferring a carbonated liquid (e.g., beer, soda, etc.) or noncarbonated liquid (e.g., milk, wine, etc.) to or from a container 166 as shown in FIGS. 11 and 12. FIG. 3 shows the apparatus 100 in a storage/transport condition (e.g., with the storage/transport cap 108 in place for storing and/or transporting a liquid within the container 166, etc.).

The end portion 113 of the transfer tube 112 is inserted through the opening 109 in the top 110 of the transfer cap 108 until the flange or shoulder portion 114 of the transfer tube 112 abuts against an inner surface of the top 110 of the transfer cap 108. The transfer tube 112 is configured to be attached to the conduit 131. As shown in FIGS. 2 and 4, one end 113 of the transfer tube 112 is barbed (e.g., includes three hose barbs 115, etc.) and sized for insertion into conduit 131.

Conduit 131 is preferably a flexible tube or hose attached to transfer tube 112 in a manner as shown thereby trapping transfer cap 108 between the flange 114 of the transfer tube 112 and the end of the conduit 131. In the exemplary embodiment, the transfer tube 112 is preferably not directly attached to the transfer cap 108 thereby allowing the transfer cap 108 to rotate freely for threaded engagement to the fitment 116 without rotation of the transfer tube 112. Optionally, a hose clamp (not shown) may be used as necessary to secure the conduit 131 to the transfer tube 112. In this embodiment, the transfer cap 108 attaches to the fitment 116 via screw threads 111, 119. Other methods of releasable attachment (e.g., snap fit, friction fit, bayonet fitment, etc.) may be alternatively employed.

Alternatively, the transfer cap 108 and transfer tube 112 may be attached directly together, e.g., heat sealed, glued, welded, (e.g., sonic, ultrasonic, chemical, etc.) or other suitable attachment method, or monolithically formed (e.g., injection molded, etc.) so as to have a single piece construction. Similarly, the conduit 131 may be attached as a separate piece or formed monolithically with the transfer cap 108 and transfer tube 112. Also, other means may be used to help retain the connection between the transfer tube 112 and the conduit 131.

The transfer tube 112 includes an end portion 121 configured to be inserted into opening 117 of fitment 116 such that, upon insertion, an airtight seal is formed between end portion 121 and opening 117. As the transfer tube 112 is inserted further into the fitment 116, the end portion 121 of the transfer tube 112 engages, opens, and extends through fitment valve 124 thereby providing an open passage to/from the container 166 into and through the transfer assembly (FIGS. 2 and 4) while maintaining an airtight seal with the outside environment.

As shown in FIG. 5, the transfer tube 112 includes a tapered portion 125 such that an outer width or diameter of tapered portion 125 decreases from top to bottom of the tapered portion 125. The tapered portion 125 is configured to wedge against and seal with the inner surface 126 of the fitment 116 that defines the opening 117, which may thereby create a more air-tight seal between the transfer tube 112 and transfer cap 108 which seal may improve with increased pressure. The transfer tube 112 may be inserted into the fitment 116 until the tapered portion 125 fits tightly and seals with the opening 117.

The valve 124 may allow flow into the container 166 (e.g., from top to bottom in FIG. 1, etc.) but prevent backflow out of the container, e.g., prevent carbonation from escaping the container, etc. The valve 124 may be opened and held open by the portion of the transfer tube 112 positioned within the valve 124.

With the transfer tube 112 positioned through the valve 124 (FIG. 5), the beer (or other liquid) is advantageously able to flow openly (e.g., in a straight line or linear flow path, without being damaged by agitation, etc.) through the transfer tube 112 into or out of the container 166. Beer added to or removed from the container 166 can flow through the transfer tube 112 without having to contact or flow around any one of the transfer cap 108, fitment 116, valve 124, and retainer 128. The transfer tube 112 may have a minimal length to thus operate as a bypass mechanism that opens the valve 124 and allows beer to bypass the valve 124 when flowing to/from a container (e.g., from a beer tap into the container, from the container into a beer glass, etc.). In this configuration, the transfer tube 112 may be relatively short to help further avoid agitation and/or to make it easier and more convenient to use. Alternatively, the transfer tube 112 may be longer, as desired, to extend into the container (e.g., to the bottom of the container in a manner commonly known as a drop tube or dip tube, etc.).

FIG. 5 shows the apparatus 100 with the transfer cap 108, transfer tube 112, and conduit 131. In this configuration, the apparatus 100 is ready to be used for transferring liquid to or from a container 166. For example, FIG. 11 shows the apparatus 100 being used to individually fill a container 166 with beer after connecting the conduit 131 via an adapter 169 to the front of a beer faucet 167. As another example, FIG. 12 shows the apparatus 100 being used to dispense beer from the container 166 after connecting the conduit 131 to the rear of the beer faucet 167.

Referring to FIGS. 1 and 3, the retainer 128 may be attached to an inner surface of the fitment 116, e.g., heat sealed, glued, welded (e.g., sonic, ultrasonic, chemical, etc.), snap fit, press fit, threaded, or other suitable attaching methods, etc. thereby trapping and retaining valve 124 in an airtight manner in the fitment 116. The retainer 128 may include a flange 132 or other feature (e.g., rib, projection, etc.) to help facilitate its attachment to the fitment 116. In some exemplary embodiments, the valve 124 and the retainer 128 are each attached to the inner surface of the fitment 116. In other exemplary embodiments, the valve 124 may be disposed within (e.g., friction or interference fit, etc.) the fitment 116 without being attached directly to the inner surface of the fitment 116. Instead, the retainer 128 may be attached directly to the inner surface of the fitment 116 for retaining the valve 124 within the fitment 116.

In this example, the valve 124 includes a flange 127 and sealing elements 129 (e.g., elastomeric lips of a duckbill valve, elastomeric cuspids of a cross-slit valve, etc.) depending from the flange 127. The retainer 128 includes an opening 130 configured to receive the sealing elements 129 therethrough.

The apparatus 100 may also be used when storing a liquid in a container when the apparatus 100 includes or is provided with the storage/transport cap 104 as shown in FIGS. 1 and 3. After the apparatus 100 with the transfer assembly (FIGS. 2 and 4) is used to fill a container with beer (or other liquid) as discussed above, the transfer cap 108 (and transfer tube 112 attached thereto) may be removed from the fitment 116. The removal of the transfer cap 108 from the fitment 116 also removes the transfer tube 112 from the valve 124. With the transfer tube 112 removed and no longer holding open the valve 124, the valve 124 may then self-close and prevent the escape of liquid or gas from the container.

The storage/transport cap 104 may then be screwed or threaded onto the fitment 116. As shown in FIG. 3, the storage/transport cap 104 includes a downwardly protruding portion 105 (e.g., annular rib, ridge, ring, protrusion, sealing element, etc.) along an inner surface of the top 106 of the cap 104. The portion 105 is configured to be received within the opening 117 when the storage/transport cap 104 is threaded onto the fitment 116, to sealingly engage the cap 104 and the fitment 116.

During the cap switch, there may be an insignificant amount of gas leakage from the container, e.g., during the time it takes for the valve 124 to self-close. But the valve 124 will still hold sufficient pressure, e.g., 20 pounds per square inch (PSI), prevent contamination, and keep the beer good during the limited amount of time needed to switch between the transfer cap 108 and the storage/transport cap 104.

The storage/transport cap 104 provides a proven, reliable pressure seal as well as a seal against contamination. For example, the storage/transport cap 104 helps keep the fitment surface 126 and the valve 124 clean for insertion of the transfer tube 112. The container (e.g., flexible container 166 (FIGS. 9, 11, and 12), etc.), the fitment 116, the valve 124, the retainer 128, and storage/transport cap 104 may be disposable, e.g., if deemed too impractical or inconvenient to clean and reuse the container, etc. The transfer assembly (FIGS. 2 and 4) may be reused over and over again (e.g., with proper cleaning, etc.) for the same liquid or for different liquids (e.g., for switching between different types of beer, etc.). The transfer assembly may be reused after cleaning. For example, the transfer cap 108 may be screwed onto a threaded spout of a flexible container of cleaning solution to thereby position the end portion 121 of the transfer tube 112 inside the flexible container. The flexible container may then be squeezed to force the cleaning solution out of the flexible container through the transfer tube 112 and conduit 131, to thereby clean the interior of the transfer tube 112 and conduit 131. As another example, the transfer tube 112 and conduit 131 may be cleaned out by using tap water.

Alternative exemplary embodiments may not include any storage/transport cap. In such embodiments, the transfer cap and transfer tube may remain with the container during storage. For example, the transfer tube may be reconfigured such that it is slidable away from and out of contact with the valve to thereby allow self-closure of the valve. The valve may then inhibit the ingress flow into and out of the container. A cap may be positioned within the open top of the transfer tube to prevent contamination (e.g., dust, etc.) from entering the transfer tube. In order to add liquid to or remove liquid from the container, the transfer tube may be slid into contact with the seal and/or valve component(s) to thereby open the seal and/or valve component(s), and the cap removed from the open top of the transfer tube.

Assuming the apparatus 100 has been used while storing beer (or other liquid) in the container, the storage/transport cap 104 may be removed from the fitment 116. The transfer cap 108 may then be screwed or threaded onto the fitment 116, and the end portion 121 of the transfer tube 112 inserted through the opening 117 in the top 118 of the fitment 116. The same transfer cap 108 and transfer tube 112 used to fill the container as described above may also be used when dispensing beer from the container 166 as shown in FIG. 12. But in alternative embodiments, the apparatus may include first and second transfer assemblies that are interchangeable. The first transfer assembly may be used for filling a container, while the second transfer assembly may be used for dispensing from the container. In which case, the second transfer assembly may remain connected to a rear of a beer faucet (e.g., FIG. 12, etc.) to allow a user to readily and conveniently switch between different containers, e.g., filled with different beers, etc.

Figure 9:
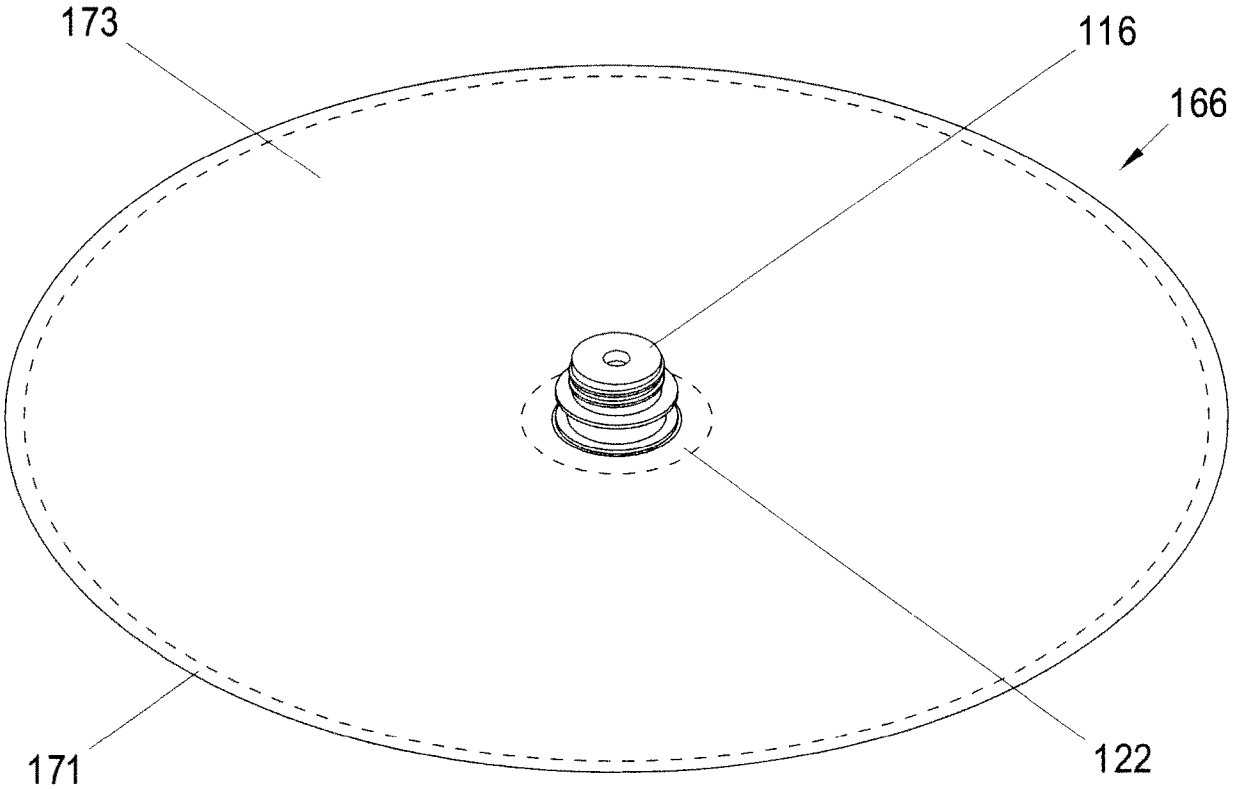
FIG. 9 is a perspective view of a flexible container shown empty in a collapsed configuration, wherein the flexible container may be used with the apparatus shown in any one of FIGS. 1-6, 10, and 13-19.

The transfer tube's end portion 121 may be inserted into and through the opening 117 of the fitment 116 and valve 124. The valve 124 may be opened and held open by the portion of the transfer tube 112 positioned within the valve 124, to thereby allow the beer (or other liquid) to flow out of the container through the transfer tube 112. By way of example, the container may comprise a flexible bag 166 as shown in FIG. 9. Beer may be dispensed from the flexible bag 166 by compressing or applying pressure to (e.g., squeezing, etc.) the flexible bag 166. The compressive forces or pressure forces beer to flow out of the flexible bag 166 through the transfer tube 112, e.g., into a glass, cup, or directly into a user's mouth should the user wish to use the transfer tube 112 as a straw. Advantageously, a separate carbonation source is not thus required for dispensing beer from the flexible bag 166. Also, this example embodiment does not require a drop tube to dispense the beer, which drop tubes are traditionally used to extend from a mouth or opening of the container into the container's reservoir or main content holding portion that holds the liquid. Optionally, a drop tube may be used as desired.

As shown in FIG. 9, a bottom portion 122 of the fitment 116 may be coupled to an inner surface of the flexible bag 166, e.g., heat sealed, glued, welded (e.g., sonic, ultrasonic, chemical, etc.), or other suitable attaching methods that provides an airtight seal, etc. By positioning the bottom portion 122 of the fitment 116 inside the flexible bag 166, pressure within the flexible bag 166 helps retain the fitment 116 against and coupled to the flexible bag 166. The flexible bag 166 may be round and configured to equally distribute stress along a seam or interface 171 between upper and lower portions 173, 175 (e.g., circular hemispherical halves, octagonal portions, multisided portions, etc.). Other shapes (e.g., square, rectangular, etc.) may also be used as desired. The upper and lower portions 173, 175 are attached (e.g., heat sealed, etc.) to each other along the seam 171. The fitment 116 may be located at about a center of the upper portion 173. Alternatively, other exemplary embodiments may be used with different containers besides the round flexible bag 166 shown in FIGS. 9, 11, and 12. By way of example, the fitment 116 may be formed integrally with a container, rigid or flexible, of practically any size and shape. Also by way of example, the apparatus 100 may be used with practically any container having sufficient strength.

With continued reference to FIGS. 1, 3, 5, and 6, the valve 124 may comprise any of a wide range of valves, including one-piece, elastomeric, self-closing, valves. In an exemplary embodiment, the valve 124 allows insertion of the transfer tube 112 from one direction and prevents fluid flow from the other. By way of example only, the valve 124 may comprise a cross-slit valve (FIG. 1) or a duckbill valve (FIG. 3). The valve 124 may be made of rubber, synthetic elastomer, food-grade silicone, etc. The duckbill valve and cross-slit-valve are each a one-piece, self-closing elastomeric component having an integral sealing function without having to rely upon a seat surface of another component to seal. The duckbill valve includes elastomeric sealing features that may be shaped similar to lips of a duckbill. The cross-slit valve includes elastomeric sealing features such as four cuspids, etc. Also by way of example only, the valve 124 may comprise a cross-slit valve or duckbill valve from Minivalve, Inc., etc. Alternatively, other means for sealing and/or controlling fluid flow besides duckbill or cross-slit valves may be used in other embodiments. In other embodiments, a plurality of valves may be used, e.g., to provide greater sealing for higher pressures, etc.

A wide variety of materials and manufacturing methods may be used for the various components of the apparatus 100 depending, for example, on the requirements of the specific application or intended end use for the apparatus 100. Example factors to be considered include the weight and volume of the liquid to be contained (size of the bag), pressure requirements due to the amount of carbonation (if any) in the liquid, pressure requirements for dispensing the liquid, chemical compatibility, compatibility of the bag material and the fitment material for bonding purposes, temperature range of the application, etc.

In an exemplary embodiment, the caps 104, 108 and the fitment 116 may be injection molded from thermoplastic material or other injection moldable material. The container 166 and components of the apparatus 100 (e.g., fitment 116, storage cap 104, etc.) may be opaque in some embodiments so that beer in the container is not exposed to light during storage as overexposure to light may damage the beer. In other exemplary embodiments, the container 166 and components of the apparatus 100 may be at least partially see-through (e.g., transparent, translucent, etc.) to allow a user to readily determine how much liquid is in the container and/or whether liquid is flowing through the transfer assembly when filling the container 166 or dispensing from the container 166.

Figure 6:
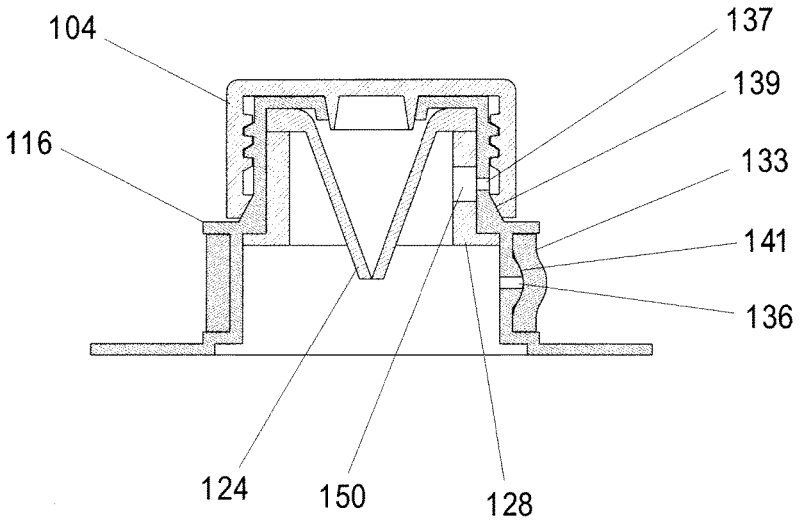
FIG. 6 is a cross-sectional view of the apparatus shown in FIG. 3, where the apparatus includes vent holes in the fitment and a removable cover member configured to be positioned over the lower vent hole for sealing the lower vent hole, and where the storage/transfer cap is configured to be positioned over the upper vent hole for sealing the upper vent hole.

In exemplary embodiments, one or more vent holes may be provided in the fitment to allow fluid such as gas to escape or release from the container through the one or more vent holes. For example, and as shown in FIG. 6, the fitment 116 includes first and second vent holes 136 and 137. The first or lower vent hole 136 may be covered and sealed by a cover member 133. The second or upper vent hole 137 may be covered and sealed by a cover member (not shown) similar to cover member 133 and/or by the storage/transfer cap 104.

The first and second vent holes 136, 137 may be located relative to the valve 124 (e.g., on the container side of the valve 124, etc.) to allow venting from the container regardless of whether the valve 124 is open or closed. As shown in FIG. 6, the first vent hole 136 is located in a neck of the fitment 116 towards a bottom of the fitment 116. In this example, the vent hole 136 is located between the outwardly protruding portions 122, 123 (e.g., flanges, shoulders, etc.) of the fitment 116. Accordingly, the cover member 133 is also positioned between the outwardly protruding portions 122, 123 of the fitment 116 when covering the vent hole 136. In which case, the outwardly protruding portions 122, 123 may then help to retain the cover member 133 in place over the vent hole 136, e.g., prevent the unintentional removal or relocation of the cover member 133 off the vent hole 136, etc.

The vent hole 136 is also located (e.g., a sufficient distance below the threads 119, etc.) such that the vent hole 136 is not covered by the storage/transport cap 104. Even when a storage/transport cap 104 or transfer cap 108 is attached to the fitment 116, the vent hole 136 may nevertheless be used to allow venting from the container 166 at any time by removing or repositioning the cover member 133 to expose the vent hole 136, e.g., such as for pressure relief in an overpressure condition, which may be particularly desirable for a carbonated liquid or for extreme temperature variations, etc.

The vent hole 136 may also be located on an outwardly protruding portion 141 (e.g., a raised bump, etc.), which increases the perimeter of the fitment portion about which the cover member 133 is positioned and concentrates the force of the elastic cover member 133 immediately around the vent hole 136, thus providing a more effective seal. Accordingly, the cover member 133 must be stretched to a great extent when covering the vent hole 136, which thereby increases the sealing pressure applied by the cover member 133. Additionally, or alternatively, the vent hole, cover member, and/or cap may be configured such that the cap presses down on the cover member to increase the sealing effect the cover member has on the vent hole and/or to help retain the cover member in place over the vent hole when the cap is in place on the fitment.

The second vent hole 137 may be located immediately below the threads 119. In this example, the vent hole 137 is covered by the storage/transport cap 104 threaded onto the fitment 116. The cap 104 and fitment 116 are configured such that a seal 139 is created between tapered or slanted sealing surfaces of the cap 104 and fitment 116. The seal 139 prevents the container 166 from venting when the cap 104 is in place. Accordingly, the vent hole 137 allows venting when the cap 104 is removed (e.g., to purge unwanted gas from the container 166, etc.). Additionally, or alternatively, other means may be used for creating the seal 139 between the cap 104 and fitment 116, such as an O-ring, etc. Transfer cap 108 may also be configured with or without seal 139, or an alternative, depending on when and how venting is desired.

The second vent hole 137 may include a cover member (not shown) similar to cover member 133 that allows venting when the cap 104 is removed, but is sealed by the cap 104 when the storage/transport cap 104 is secured to the fitment 116. In this manner, venting is allowed, for example during filling (e.g., to relieve excess pressure from the container, etc.), but not allowed during storage/transport.

Alternatively, other embodiments may include only the first vent hole 136 or the second vent hole 137, but not both. Still other embodiments may include one or more vent holes located elsewhere in the fitment depending on the particular application or end use. For example, the fitment may include a plurality of vent holes circumferentially spaced apart along a perimeter of the fitment.

Figure 7:
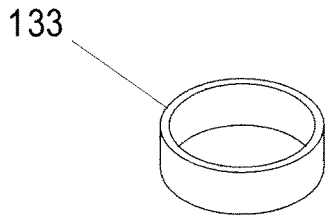
FIG. 7 is a perspective view of an example cover member that may be positioned over the lower vent hole in the fitment shown in FIG. 6.

FIG. 7 illustrates an example cover member 133 that may be positioned over the lower vent hole 136 in the fitment 116 shown in FIG. 6. The cover member 133 (e.g., elastic band, etc.) may be positioned around the fitment 116 to cover and seal the first vent hole 136, e.g., to inhibit or prevent ingress of air into the container through the first vent hole 136 and/or to prevent carbonation from escaping the container through the first vent hole 136, etc. The cover member 133 may also be removed from the fitment 116 or repositioned (e.g., pulled outwardly away from the fitment 116, slid upward or downward, etc.) to expose the vent hole 136, e.g., to allow fluid such as gas to escape or release from the container through the vent hole 136, etc. as desired. Accordingly, the cover 133 and vent hole 136 may thus be used as a purge or pressure relief valve.

Figure 8:
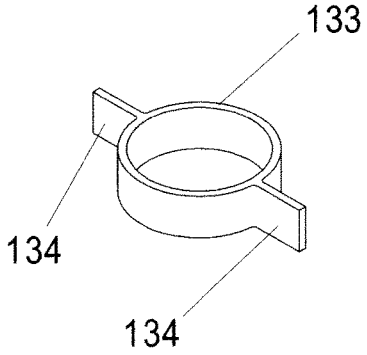
FIG. 8 is a perspective view of the example cover member shown in FIG. 7, where the cover member includes pull tabs.

As shown in FIG. 8, the cover member 133 may also include tabs 134 protruding outwardly from an annular (e.g., circular, etc.) portion. The tabs 134 may allow a user to more easily remove or reposition the cover member 133 relative to the first vent hole 136, e.g., to allow fluid such as gas from the container to vent through the first vent hole 136 when the container is being filled in an upright position, etc.

The cover member 133 may be made from various materials. In an exemplary embodiment, the cover member 133 may be formed from a resiliently stretchable or elastic material (e.g., rubber, etc.) that is capable of being stretched to fit generally over and snugly fit against the fitment 116 and the first vent hole 136. The configuration of the cover member 133 and first vent hole 136 (e.g., durometer, shape, and size of the cover member 133, shape, size, and location of the vent hole(s), and/or number of holes, etc.) may vary depending on the particular application or end use. By way of example, the cover member 133 and first vent hole 136 may be configured to prevent over pressurization of the container. For example, the cover member 133 and first vent hole 136 may be configured such that relatively high pressure will cause movement of the cover member 133 outwardly away from the first vent hole 136 to thereby automatically allow gas to escape and lower the pressure without the user having to manually move or reposition the cover member 133.

The retainer 128 may include a hole or opening 150 so that the retainer 128 does not obstruct the vent hole 136. By way of example (FIG. 6), the hole 150 in the retainer 128 is aligned with the vent hole 136. In another exemplary embodiment, the retainer 128 may include a number of holes or openings such that the vent hole 136 cannot be obstructed by the retainer 128 regardless of the orientation of the retainer 128. In other embodiments, the retainer 128 may include one or more grooves, channels, etc. instead of holes.

FIG. 12 illustrates the apparatus 100 and flexible container 166 shown positioned within a pressure vessel 170 as part of a dispenser 200 (partially shown). As shown, the apparatus 100 may be used to dispense beer from the container 166 when the conduit 131 is connected to the rear of the beer faucet 167. The beer faucet 167 may be mounted on a wall 181 of the dispenser 200, etc. The pressure vessel 170 and flexible container 166 may be configured (e.g., shaped, sized, form fitting, etc.) relative to each other such that at least the bottom or lower portion 175 of the flexible container 166 conforms (e.g., form fitting, etc.) to or against the corresponding bottom or lower portion of the pressure vessel 170.

As shown in FIG. 12, the pressure vessel 170 includes a chamber 176 (e.g., aluminum housing, etc.) and outer insulation 178 surrounding the chamber 176. The pressure vessel 170 includes an openable lid or top 180 also preferably covered by outer insulation 178. A seal 182 (e.g., an O-ring, etc.) is disposed between the lid 180 and the lower portion of the pressure vessel 170.

A thermoelectric cooling system 174 (e.g., thermoelectric module, fan, heat sink, etc.), or other cooling system, is positioned toward or at a bottom of the pressure vessel 170. The thermoelectric cooling system 174 may be operable for reducing and maintaining temperature of beer within the flexible container 166 to a sufficiently low enough level so that the beer will not be damaged due to heat.

The pressure vessel 170 also includes a pressurized source of gas or other means 184 (e.g., pump, etc.) for adding fluid (e.g., air, etc.) into the pressure vessel 170. For example, a pump or compressor may be used to add air to the pressure vessel 170 to increase the air pressure therein. The increased air pressure squeezes or applies a compression force to the flexible container 166. In response, the flexible container's sidewall(s) are caused to flex and force liquid to flow out of the flexible container 166 through the transfer tube 112, conduit 131, and beer faucet 167. As the liquid is dispensed, the flexible container 166 collapses, but air may be added within the space between the rigid container 170 and the flexible container 166 to compress the flexible container 166 and force the liquid out. Advantageously, this process thus does not require a separate compressed gas source to add pressure into the reservoir or main content holding portion of the flexible container 166.

The flexible container 166 may comprise a flexible round bag that is expandable when being filled with liquid and collapsible when liquid is dispensed. The flexible container 166 may be round and configured to equally distribute stress along the seam or interface 171 between upper and lower portions 173, 175 (e.g., upper and lower halves, upper and lower circular hemispherical portions, etc.). The stress may be created or caused, for example, due to the weight of the liquid within the flexible container 166. The magnitude of the stress will depend on the particular liquid and amount within the flexible container 166. The stress may also be created or caused, for example, when the flexible container 166 is compressed to dispense the liquid, such as by increasing air pressure around the flexible container 166, manually squeezing the flexible container 166, by the pressure of carbonation of the liquid in the container 166, changes in temperature, etc.

Although FIG. 12 shows the flexible container 166 being used with the pressure vessel 170, the flexible container 166 may also be used in other ways and/or with other systems. For example, the flexible container 166 may simply be placed on a horizontal support surface (e.g., a table, a bar top, etc.) without the rigid container 170. In this example, a user may manually cause the liquid to be dispensed from the reservoir of the flexible container 166 through the transfer tube 112 and conduit 131 by squeezing or pressing down on the flexible container 166, etc. Or, for example, the flexible container 166 may be carried and used as a portable drink dispenser, e.g., with the transfer tube 112 or conduit 131 used as a spigot to fill a cup or used as a straw where a user may drink directly from the end of the transfer tube 112 or conduit 131, etc.

While dispensing a beverage, for example, from a container (e.g., as shown in FIG. 12, manually as described above, etc.), it may be desirable to switch from the current, or first, brand, flavor, type, etc., of beverage to an alternative, or second, brand, flavor, type, etc., before the first container is empty. In this event, utilizing apparatus 100 as described herein, the first container can be replaced by the second container without damaging the beverage remaining in the first container. The first container may be stored (e.g., refrigerated, etc.) and reconnected for dispensing using apparatus 100 when desired.

The flexible container 166 may be individually filled with liquid (e.g., carbonated liquid, etc.) and/or liquid may be stored within and/or dispensed from the flexible container 166 while using an apparatus (e.g., 100, etc.) disclosed herein. By way of example, a fitment (e.g., 116, etc.) disclosed herein may be attached to an inner surface of the flexible container 166, e.g., heat sealed, glued, welded (e.g., sonic, ultrasonic, chemical, etc.), or other suitable attaching methods that provides an airtight seal between the fitment and container, etc. Alternatively, fitment 116 may be integrally formed with a container.

Figure 14:
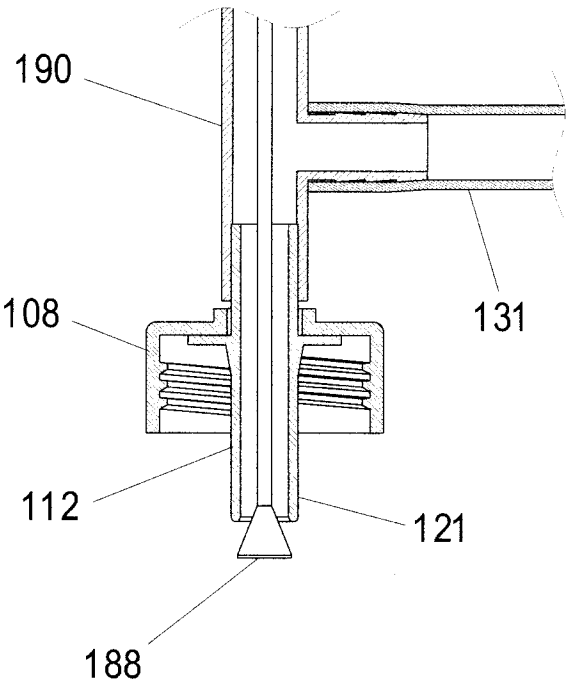
FIGS. 13 through 16 illustrate example valve assemblies that may be used for purging air from the transfer tube shown in FIGS. 2, 4, and 5.
Figure 13:
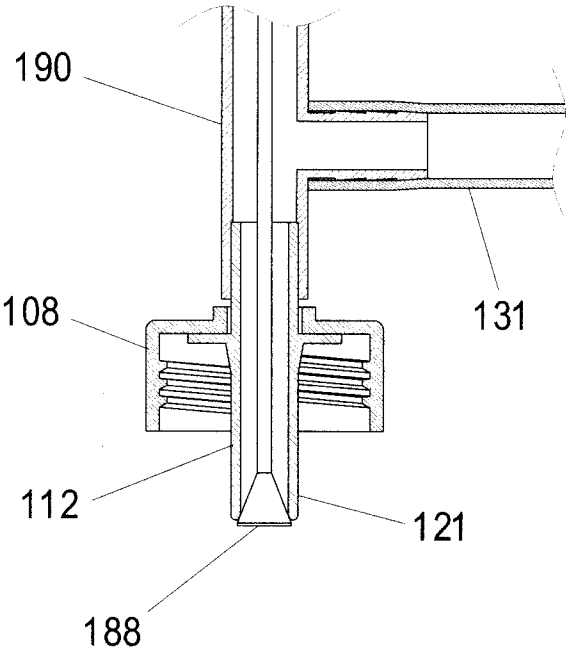

FIGS. 13 and 14 illustrate an example valve assembly 186 attached between the transfer tube 112 and conduit 131. The valve assembly 186 may be used for purging air from the transfer tube 112. The valve assembly 186 includes a movable valve member 188 that is moveable relative to the end portion 121 of the transfer tube 112 between a closed position (FIG. 13) and an open position (FIG. 14). FIG. 14 shows the valve member 188 in an open position in which the valve member 188 is spaced apart from the end of the transfer tube 112 such that liquid may flow through and out of the transfer tube 112. The open valve allows fluid flow out of the transfer tube 112. Liquid may be introduced into the transfer tube 112 via the conduit 131 and T-shaped tube connector 190 forcing the air out of the open end of the valve assembly 186. Once all of the air is displaced, the valve 186 may be closed, as shown in FIG. 13. The valve assembly 186 may now be attached to and used to fill a container with liquid that has not been exposed to air.

Figure 16:
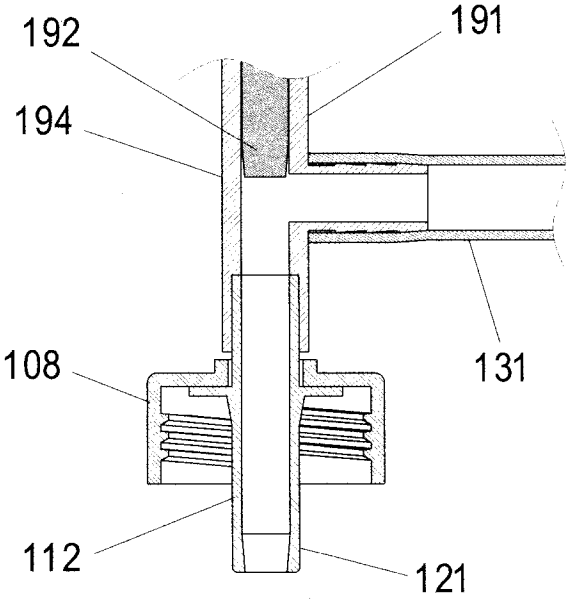
Figure 15:
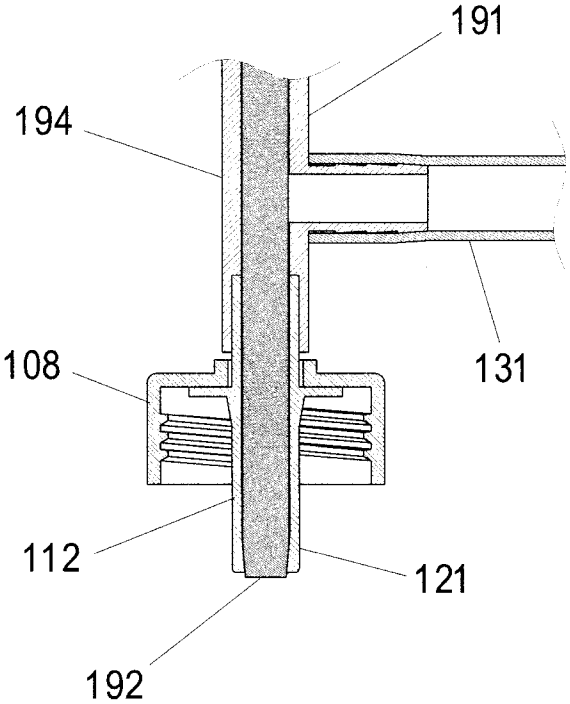

FIGS. 15 and 16 illustrate another example valve assembly 191 attached between the transfer tube 112 and conduit 131. The valve assembly 191 may be used for purging air from the transfer tube 112. The valve assembly 191 includes a movable valve member 192 that is moveable relative to the end portion 121 of the transfer tube 112 between a closed position (FIG. 15) and an open position (FIG. 16). FIG. 16 shows the valve member 192 in an open position in which the valve member 192 is spaced apart from the end of the transfer tube 112 such that liquid may flow through and out of the transfer tube 112. The open valve allows fluid flow out of the transfer tube 112. Liquid may be introduced into the transfer tube 112 via the conduit 131 and T-shaped tube connector 194 forcing the air out of the open end of the valve assembly 191. Once all of the air is displaced, the valve 191 may be closed, as shown in FIG. 15. The valve assembly 191 may now be attached to and used to fill a container with liquid that has not been exposed to air.

Figure 17:
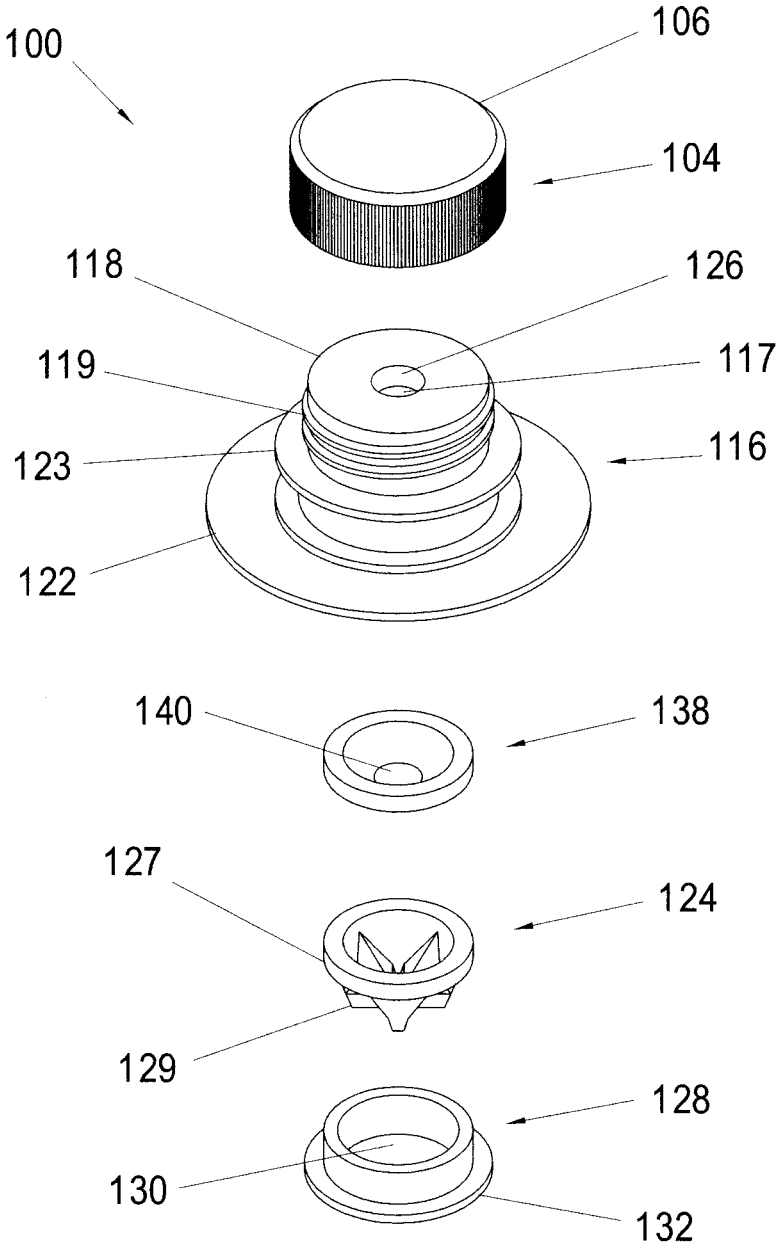
FIG. 17 is an exploded view of the apparatus shown in FIG. 1 with an alternative seal configured to be positioned within the fitment such that the transfer tube is inserted through a hole in the seal and an airtight seal is formed between the seal and the transfer tube.
Figure 20:
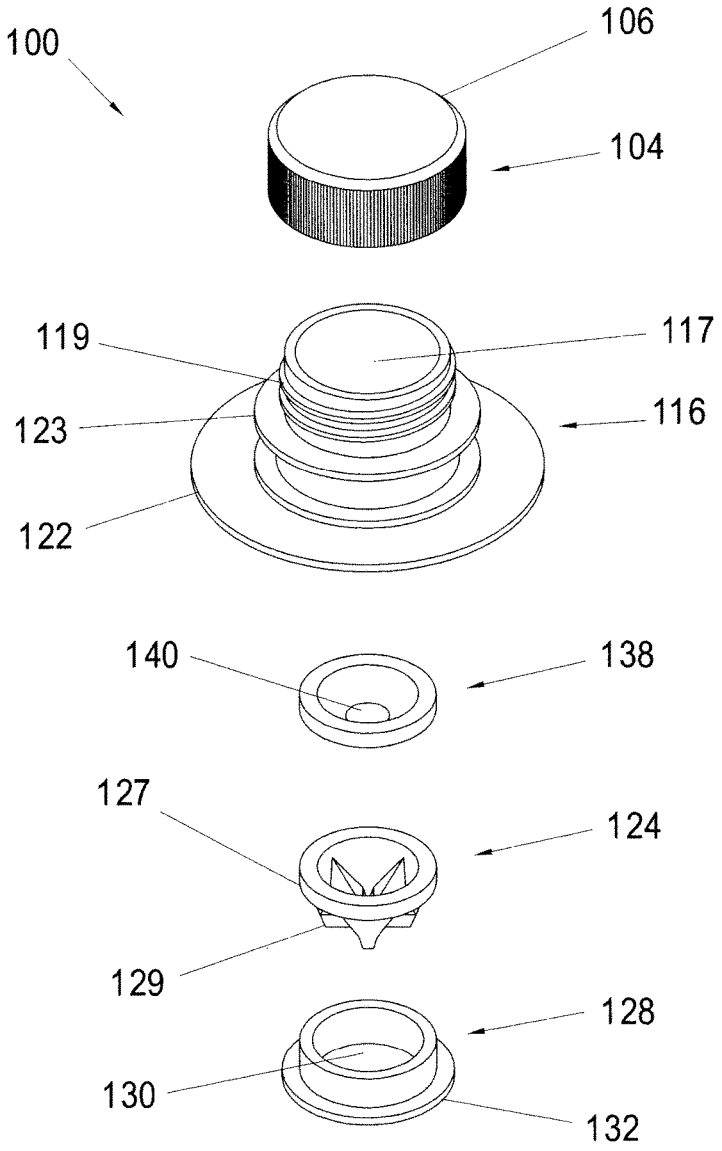
FIG. 20 is an exploded view of the apparatus shown in FIG. 17 where the fitment includes an opening larger than the transfer tube diameter.

As shown in FIGS. 17 and 20, the apparatus 100 may further include a seal component 138. The seal component 138 is configured to be positioned within the fitment 116 such that the end portion 121 of the transfer tube 112 engages and extends through an opening 140 in the seal component 138. With the seal component 138 disposed around (e.g., disposed circumferentially around, sealed against, etc.) the outer surface of the transfer tube 112, an airtight seal is formed between the seal component 138 and the transfer tube 112.

In FIG. 17, an airtight seal is formed between the transfer tube's end portion 121 and opening 117 in the fitment 116. Accordingly, the seal component 138 may also be referred to as and/or provide a backup or secondary seal when there is a seal also formed between the transfer tube's end portion 121 and opening 117 in the fitment 116 as disclosed above. But, by way of example in FIG. 20, the opening 117 in the fitment 116 is much larger than a diameter of the transfer tube 112 such that an airtight seal is not formed between the transfer tube's end portion 121 and opening 117 in the fitment 116. As shown in FIG. 20, a relatively large diameter opening 117 may be provided if desired, without sacrificing the features and benefits described herein.

Figure 18:
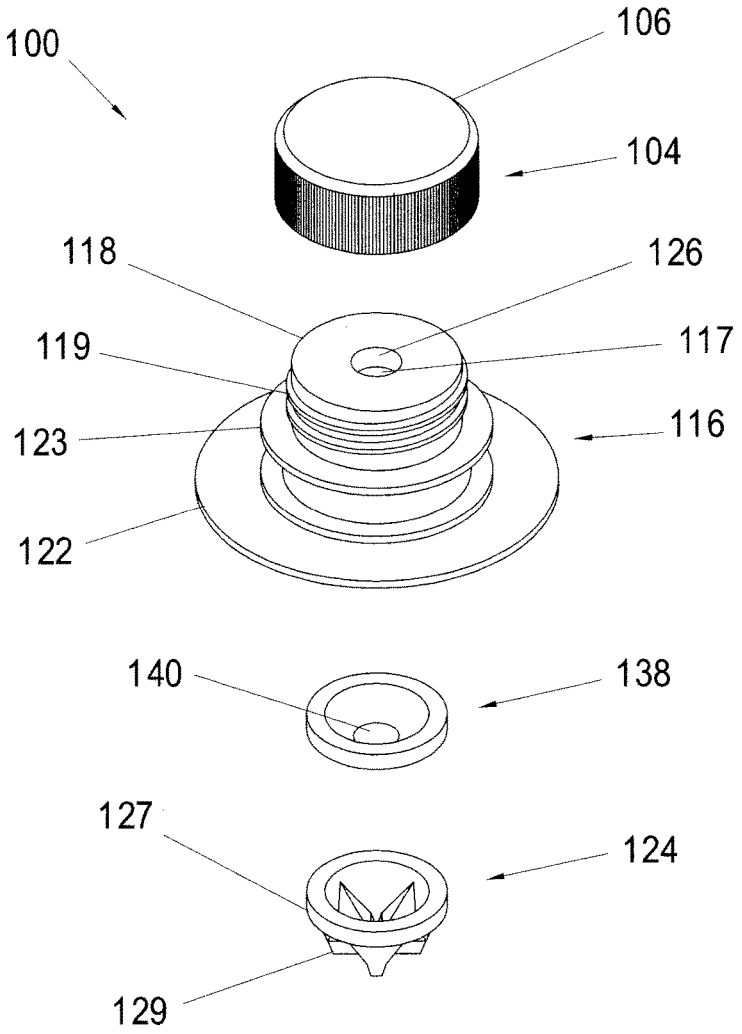
FIG. 18 is an exploded view of the apparatus shown in FIG. 17 without the retainer.

FIG. 18 shows the apparatus 100 without the retainer 128. Instead, the valve 124 and seal 138 may each be attached to an inner surface of the fitment 116, e.g., heat sealed, glued, welded (e.g., sonic, ultrasonic, chemical, etc.), snap fit, press fit, threaded, or other suitable attaching methods, etc. Or, for example, only the valve 124 may be attached to an inner surface of the fitment 116, and the seal 138 may be disposed within (e.g., friction or interference fit, etc.) the fitment 116 without being attached directly to the inner surface of the fitment 116.

Figure 19:
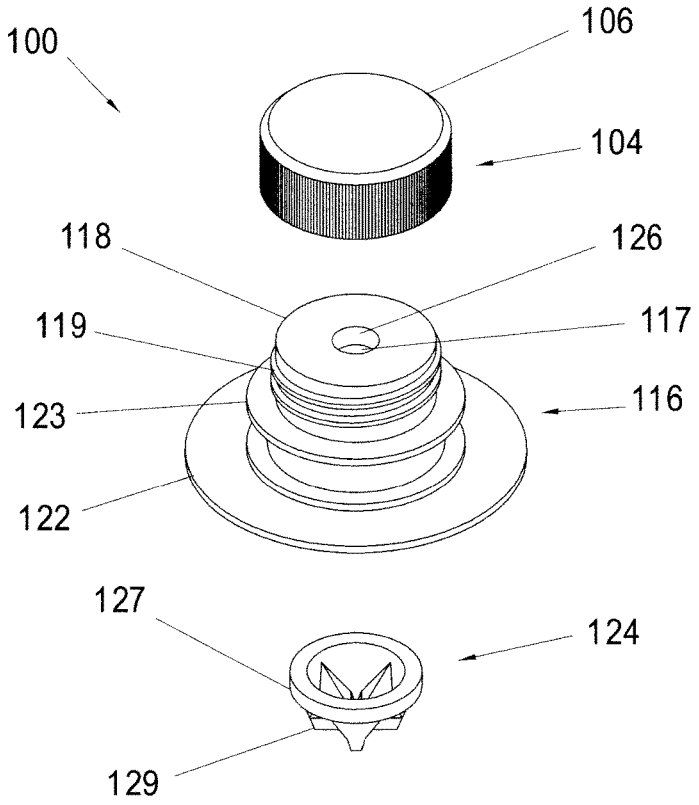
FIG. 19 is an exploded view of the apparatus shown in FIG. 18 without the backup seal.

FIG. 19 shows the apparatus 100 without the retainer 128 and without the seal 138. In this example, the valve 124 may be attached to an inner surface of the fitment 116, e.g., heat sealed, glued, welded (e.g., sonic, ultrasonic, chemical, etc.), snap fit, press fit, threaded, or other suitable attaching methods, etc.

Exemplary embodiments may be configured to be added to or retrofitted to an existing container, e.g., by positioning a fitment over a spout or neck of the existing container (e.g., growler, bottle, rigid container, flexible container, etc.) and sealing the interface therebetween. For example, the fitment may comprise a material having sufficient resiliency to be stretched out to fit over a spout or neck of an existing container and then conformingly seal against the spout or neck. In such exemplary embodiments, the existing container may be full of air. For example, a rigid container will be full of air (or some gas) when empty. Having a vent hole in the fitment as disclosed herein may advantageously allow the air in the existing rigid container (or other container) to escape when filling the container with liquid.

In an exemplary embodiment, the fitment may include an upwardly protruding portion (e.g., rib, ridge, protrusion, sealing element, etc.) along the top of the fitment. The upwardly protruding portion may be configured to be received within a corresponding recessed portion along an inner surface of the top of the storage/transport cap and/or transfer cap. The positioning of the fitment's upwardly protruding portion within the cap's recessed portion may help sealingly engage the cap and the fitment when the cap is in place. The fitment's upwardly protruding portion may define a circular ring along the top surface of the fitment. The inner surface of the top of the storage/transport cap and/or transfer cap may define a recessed portion having a circular shape corresponding to the circular shape of the fitment's upwardly protruding portion. In yet another exemplary embodiment, the storage/transport cap and/or transfer cap may include a gasket to help seal the interface between the cap and the fitment. Alternatively, any appropriate sealing method may be used.

In an exemplary embodiment, the container's reservoir holding the liquid remains sealed in an air-tight manner during use, e.g., when the container is being filled with beer (or other liquid), stored for later use, and emptied, such as when beer is being dispensed for consumption or to discard. Advantageously, this allows for the elimination of a separate carbonation source that is traditionally required for dispensing beer. Also, example embodiments do not require a drop tube to dispense the liquid, which drop tubes are traditionally used to extend from a mouth or opening of the container into the container's reservoir that holds the liquid.

Because exemplary embodiments do not require a separate carbonation source that adds carbonation into the container's interior or reservoir holding the liquid, exemplary embodiments may also be used with non-carbonated liquids, such as wine, milk, etc. Accordingly, exemplary embodiments of the present disclosure should not be limited to use with any particular liquid. For example, exemplary embodiments disclosed herein may be particularly useful when used for transferring and/or storing beer. But exemplary embodiments disclosed herein may also or instead be used with other carbonated beverages besides beer (e.g., tonic water, soda, etc.) as well as with non-carbonated liquids (e.g., wine, milk, etc.).

Exemplary embodiments of the apparatus (e.g., 100, etc.) disclosed herein may also be used by small-quantity beer brewers (e.g., home brewers, etc.) to avoid the painstaking, cumbersome, and time consuming process of having to individually clean and fill bottles. Also, the typical carbonation step may be simplified by providing a forced-carbonation kit that utilizes apparatus 100. Instead of the typical method of adding additional sugar immediately prior to bottling to cause carbonation, a simple kit may be provided to directly carbonate a relatively large container (or a number of relatively large containers simultaneously) rather than numerous individual beer bottles one at a time. An example of such a kit would include one or more of apparatus 100 adapted to be connected to a regulated source of pressurized carbon dioxide in order to facilitate the forced carbonation process commonly known in the brewing industry. Also, for large brewers, the methods and apparatus described herein provide an alternative to canning/bottling.

Exemplary embodiments of the apparatus (e.g., 100, etc.) disclosed herein may be used with a wide range of container sizes, shapes, and types (e.g., disposable, flexible, rigid, and/or portable containers, etc.) and/or containers made from various materials (e.g., plastic, polymer, metal, glass, or any other suitable material, etc.). For example, exemplary embodiments of the apparatus (e.g., 100, etc.) disclosed herein may be used with the flexible round container 166 shown in FIGS. 9, 11, and 12. But the flexible round container 166 is merely an example of one type of container for which an apparatus disclosed herein may be used. Accordingly, aspects of the present disclosure should not be limited to use with any one particular type of container.

In exemplary embodiments, the storage/transport cap (e.g., 104, etc.) and transfer cap (e.g., 108, etc.) are configured to be threaded onto the fitment (e.g., 116, etc.). The threaded configuration (e.g., thread pitch, diameter, etc.) shown in the figures may be configured differently in other embodiments. In addition, other exemplary embodiments may rely upon a different connection between a fitment and a cap besides threads. For example, the threads may be replaced with another means of attachment, such as a friction fit, snaps, clips, etc. in other embodiments.

Also, exemplary embodiments and aspects of the present disclosure should not be limited to use with any particular liquid. For example, exemplary embodiments disclosed herein may be particularly useful when used for transferring and/or storing beer. But exemplary embodiments disclosed herein may also or instead be used with other carbonated beverages besides beer (e.g., water, soda, etc.) as well as with non-carbonated fluids (e.g., wine, milk, other liquids, gas, etc.).

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An apparatus configured for carbonated beverage dispensing, the apparatus comprising:

a collapsible beverage container including a fitment having an opening;

a transfer cap including an opening and configured to be coupled to the fitment such that at least a portion of the transfer cap is in contact with at least a portion of the fitment and such that the opening of the transfer cap is aligned with the opening of the fitment;

a valve within the fitment and configured to inhibit fluid flow out of the container; and a transfer tube including a flange or shoulder and configured to be positioned through the aligned openings of the transfer cap and the fitment, whereby the transfer tube engages and opens the valve to thereby provide an open passage to and/or from the container through which fluid is transferrable for dispensing fluid from within the container and for filling the container with fluid, and the flange or shoulder of the transfer tube is located between the transfer cap and the fitment.

2. The apparatus of claim 1, wherein the transfer tube engages and opens the valve to thereby provide the open passage to and/or from the container while maintaining an airtight seal formed directly between an outer surface of the transfer tube and a surface of the fitment, whereby beer is transferrable into and/or from the container via the transfer tube without exposure to an environment outside the container until the beer is dispensed from the transfer tube.

3. The apparatus of claim 1, wherein the transfer tube includes a portion having an outer surface and configured to be inserted into the opening of the fitment such that, upon insertion of the portion of the transfer tube into the opening of the fitment, a seal is formed directly between the outer surface of the portion of the transfer tube and an inner surface of the fitment that defines the opening of the fitment.

4. The apparatus of claim 3, wherein the inner surface of the fitment that defines the opening of the fitment is tapered and configured to seal and wedge against the portion of the transfer tube.

5. The apparatus of claim 1, further comprising a storage/transport cap configured to be coupled to the fitment when the transfer cap is not in place on the fitment, wherein the storage/transport cap includes a portion configured to sealingly engage the storage/transport cap and the fitment.

6. The apparatus of claim 1, wherein the transfer tube is rotatably coupled to the transfer cap such that the transfer tube is rotatable relative to the transfer cap and such that the transfer cap is engageable with the fitment without having to rotate the transfer tube, and wherein the transfer tube is rotatable relative to the container when the transfer tube is positioned through the aligned openings of the transfer cap and the fitment.

7. The apparatus of claim 1, wherein the transfer tube includes:

a first end portion configured to be positioned through the aligned openings of the transfer cap and the fitment to thereby open the valve and provide the open passage to and/or from the container; and a second end portion configured to be coupled to a faucet to thereby provide an open passage to and/or from the faucet such that the container is movable relative to the faucet within a space defined by a length of the transfer tube.

8. The apparatus of claim 7, wherein the transfer tube comprises a flexible conduit having a length and the second end portion, which is configured to be coupled to the faucet such that the container is movable relative to the faucet within a space defined by the length of the flexible conduit.

9. The apparatus of claim 1, wherein the fitment includes a vent hole for allowing fluid to vent from the container.

10. The apparatus of claim 9, further comprising a cover member for opening and/or closing the vent hole at a predetermined pressure.

11. The apparatus of claim 9, further comprising a cover member for selectively closing and/or opening the vent hole.

12. The apparatus of claim 11, wherein the cover member comprises:

an elastomeric band including a portion configured to be disposed around the fitment for covering the vent hole; and/or a storage/transport cap configured to be coupled to the fitment when the transfer cap is not in place on the fitment, whereby the storage/transport cap covers and seals the vent hole when the storage/transport cap is coupled to the fitment.

13. The apparatus of claim 1, wherein the container comprises a flexible container having a flexible sidewall such that the flexible container is expandable when being filled with fluid and collapsible when fluid is dispensed from the flexible container.

14. A system comprising the apparatus of claim 13, and further comprising a pressure vessel, wherein the flexible container is removably disposed within the pressure vessel, whereby fluid may be forced out of the flexible container by increasing pressure within the pressure vessel, which increased pressure compresses the flexible container and causes the flexible sidewall to flex, which forces fluid to flow out of the flexible container through the transfer tube.

15. The apparatus of claim 13, wherein:

the flexible container includes first and second portions with a seam therebetween; and the flexible container is configured such that stress due to the weight or pressure of liquid within the flexible container is distributed along the seam.

16. The apparatus of claim 1, wherein the transfer tube defines an open flow path into and out of the container, when the transfer tube is positioned through the aligned openings of the transfer cap and the fitment, through which fluid is openly flowable without having to contact or flow around any one of the transfer cap, the fitment, and the valve, which thereby helps avoid agitation of the fluid.

17. A system including the apparatus of claim 1, wherein the system is operable for filling the container with beer and for dispensing the beer from within the container without increasing the internal pressure within the container from within the container to dispense the beer, wherein the container is reusable and the system is operable for refilling the container with beer.

18. The apparatus of claim 1, wherein the container comprises a flexible container configured such that a fluid is dispensable out of the flexible container, without increasing the internal pressure within the flexible container from within the flexible container, by compressing the flexible container to force the fluid to flow out of the flexible container through the transfer tube.

19. A beer dispenser comprising the apparatus of claim 1 and a pressure vessel, wherein the container comprises a flexible container disposed within and removable from the pressure vessel, and configured such that beer is dispensable out of the flexible container, without increasing the internal pressure within the flexible container from within the flexible container, by increasing pressure within the pressure vessel, which increased pressure compresses the flexible container and forces beer to flow out of the flexible container through the transfer tube, and wherein the flexible container is fillable with beer through the transfer tube.

20. The beer dispenser of claim 19, wherein:

the pressure vessel includes a chamber in which the flexible container is disposed and an openable lid for accessing the chamber;

a beer faucet connected to the transfer tube via a conduit that is flexible such that the flexible container is movable relative to the faucet within a space defined by a length of the conduit;

a cooling system operable for reducing and maintaining temperature of the beer within the flexible container, and a pressurized source of fluid for adding fluid into the pressure vessel to increase the pressure within the pressure vessel, which increased pressure applies an external compression force to the flexible container and forces beer to flow out of the flexible container through the transfer tube, the conduit, and the beer faucet.

21. The apparatus of claim 1, wherein:

the transfer cap includes a top and an opening in the top;

the transfer tube includes a first portion and a second portion, and the flange or shoulder is between the first and second portions;

the first portion of the transfer tube is positionable through the opening in the top of the transfer cap such that the flange or shoulder abuts an inner surface of the top of the transfer cap; the second portion of the transfer tube is positionable into the opening of the fitment such an airtight seal is formed between the second portion of the transfer tube and an inner surface of the fitment that defines the opening of the fitment; and the apparatus further comprises a flexible conduit attached to the first portion of the transfer tube such that the transfer cap is trapped between the flange or shoulder of the transfer tube and an end portion of the flexible conduit and such that the transfer cap is rotatable relative to the transfer tube; and the flexible conduit includes an end portion configured to be coupled to a faucet to thereby provide an open passage to and/or from the faucet such that the container is movable relative to the faucet within a space defined by a length of the flexible conduit.

22. The apparatus of claim 1, wherein the transfer tube is rotatable relative to the container when the transfer tube is positioned through the aligned openings of the transfer cap and the fitment.

23. The apparatus of claim 1, wherein the transfer cap and the transfer tube are configured to be usable for filling the container with a carbonated beverage and for dispensing a carbonated beverage from the container; and wherein the container, the transfer cap and the transfer tube are configured to be reusable for refilling the container with a carbonated beverage.

24. The apparatus of claim 1, wherein an airtight seal between the transfer tube and the surface of the fitment is defined before the transfer tube opens the valve.

25. An apparatus comprising:

a collapsible container including a fitment having an opening;

a valve within the fitment and configured to inhibit flow out of the container;

a tube having a flange or shoulder and a first end portion configured to be positioned in the opening of the fitment to engage and open the valve to thereby provide an open passage to and/or from the container; and a cap configured to couple the tube to the fitment such that at least a portion of the cap is in contact with at least a portion of the fitment and such that the flange or shoulder of the tube is located between the cap and the fitment;

the tube having a second end portion configured to be coupled to a faucet to thereby provide an open passage to and/or from the faucet such that the container is movable relative to the faucet within a space defined by a length of the tube between the first and second end portions.

26. The apparatus of claim 25, wherein the tube engages and opens the valve to thereby provide an open passage to and/or from the container for dispensing fluid from within the container and for filling the container with fluid.

27. The apparatus of claim 25, wherein the tube is rotatable relative to the container when the conduit is positioned in the opening of the fitment.

28. The apparatus of claim 25, wherein an airtight seal between the tube and the surface of the fitment is defined before the first end portion of the tube opens the valve.

29. The apparatus of claim 25, wherein the tube comprises a transfer tube having the first end portion and a flexible conduit having a length and the second end portion configured to be coupled to the faucet such that the container is movable relative to the faucet within a space defined by the length of the flexible conduit.

30. The apparatus of claim 25, wherein an inner surface of the fitment defines the opening of the fitment, and the inner surface of the fitment that defines the opening of the fitment is tapered and configured to seal and wedge against the first end portion of the tube.

31. An apparatus comprising:

a collapsible container including an opening;

a valve positioned relative to the opening and configured to inhibit flow out of the container through the opening;

a conduit having a flange or shoulder and a first end portion configured to be positioned in the opening to engage and open the valve to thereby provide an open passage to and/or from the container; and a cap configured to couple to the conduit and the container such that at least a portion of the cap is in contact with at least a portion of a surface defining the opening and such that the flange or shoulder of the conduit is located between the cap and the surface defining the opening;

the conduit having a second end portion configured to be coupled to a faucet to thereby provide an open passage to and/or from the faucet such that the container is movable relative to the faucet within a space defined by a length of the conduit between the first and second end portions.

32. The apparatus of claim 31, wherein at least one of the conduit and the surface defining the opening is configured such that an airtight seal between the conduit and the surface defining the opening is defined before the conduit opens the valve.

33. The apparatus of claim 31, further comprising a spout that includes the surface defining the opening of the container, and wherein the valve is within the spout, and wherein the conduit comprises a transfer tube having the first end portion and a flexible hose having a length and the second end portion configured to be coupled to the faucet such that the container is movable relative to the faucet within a space defined by the length of the flexible hose.

34. The apparatus of claim 31, wherein the conduit engages and opens the valve to thereby provide an open passage to and/or from the container for dispensing fluid from within the container and for filling the container with fluid.

35. The apparatus of claim 31, wherein the conduit is rotatable relative to the container when the conduit is positioned in the opening.

* * * * *